US007942792B1

(12) United States Patent
Wyman et al.

(10) Patent No.: US 7,942,792 B1
(45) Date of Patent: May 17, 2011

(54) EXERCISE APPARATUS

(75) Inventors: Dennis Wyman, Amelia Island, FL (US); Andes Hruby, Cannan, CT (US)

(73) Assignee: OK-1 Manufacturing Company, Altus, OK (US)

( * ) Notice: Subject to any disclaimer, the term of this patent is extended or adjusted under 35 U.S.C. 154(b) by 0 days.

(21) Appl. No.: 12/637,482

(22) Filed: Dec. 14, 2009

Related U.S. Application Data

(60) Provisional application No. 61/201,712, filed on Dec. 12, 2008.

(51) Int. Cl.
*A63B 21/075* (2006.01)

(52) U.S. Cl. ..... 482/93; 482/107; 482/108

(58) Field of Classification Search ..... 482/82, 482/92–94, 99, 106–110, 141; 463/47.2; 403/292, 348, 349
See application file for complete search history.

(56) References Cited

U.S. PATENT DOCUMENTS

| | | | | | |
|---|---|---|---|---|---|
| 777,478 | A * | 12/1904 | Minor | 482/93 |
| 1,138,196 | A * | 5/1915 | Diehl | 482/106 |
| 1,536,048 | A * | 5/1925 | Alastalo | 482/108 |
| 1,917,566 | A * | 7/1933 | Wood | 482/108 |
| 4,076,236 | A * | 2/1978 | Ionel | 482/108 |
| 4,566,690 | A * | 1/1986 | Schook | 482/108 |
| 4,948,123 | A * | 8/1990 | Schook | 482/107 |
| 5,090,693 | A * | 2/1992 | Liang | 482/108 |
| 5,464,379 | A * | 11/1995 | Zarecky | 482/108 |
| 5,628,716 | A * | 5/1997 | Brice | 482/106 |
| 6,540,650 | B1 * | 4/2003 | Krull | 482/107 |
| 6,776,741 | B2 * | 8/2004 | Burwell | 482/108 |
| 6,939,276 | B2 * | 9/2005 | Gates | 482/111 |
| 7,037,245 | B2 * | 5/2006 | Burwell | 482/108 |
| 7,172,534 | B1 * | 2/2007 | Joy et al. | 482/82 |
| 7,563,208 | B1 * | 7/2009 | Chen | 482/93 |
| 7,654,939 | B1 * | 2/2010 | Lin | 482/93 |
| 2010/0273613 | A1 * | 10/2010 | Poblete Castro et al. | 482/93 |

FOREIGN PATENT DOCUMENTS

| | | | |
|---|---|---|---|
| SU | 1662589 | A1 * | 7/1991 |
| TW | 361274 | U * | 7/2009 |

* cited by examiner

*Primary Examiner* — Loan Thanh
*Assistant Examiner* — Victor K Hwang
(74) *Attorney, Agent, or Firm* — Hall Estill Law Firm

(57) ABSTRACT

An exercise apparatus includes a pair of end cap assemblies, a plurality of disk assemblies and a plurality of weight assemblies. The plurality of disk assemblies and the plurality of weight assemblies are preferably secured between the end cap assemblies, in an alternating fashion. Each of the end cap assemblies also includes a handle that is preferably aligned in the same plane the handle of the other end cap assembly.

18 Claims, 6 Drawing Sheets

EXERCISE APPARATUS

RELATED APPLICATIONS

The present application claims the benefit of U.S. Provisional Patent Application No. 61/201,712, entitled "Exercise Apparatus," filed Dec. 12, 2008.

FIELD OF THE INVENTION

The present invention generally relates to the field of exercise equipment.

BACKGROUND

The home fitness equipment industry is dominated by devices that require extensive space and often target only one particular type of exercise. The products include motorized treadmills, stationary bikes, stairclimbers, rowing machines, elliptical cross-trainers, free weights and similar equipment. The popularity of such home exercise equipment is due in part to the fact that it allows users to train in the privacy of their own home without the necessity of visiting a commercial gym. The cost of the available home exercise equipment makes acquisition unaffordable for a large segment of the target market. To save costs, the existing products ship with a limited ability to modify the work load of the product, i.e., to add or remove the weight or resistance of the equipment so that the user can effectively complete an exercise. Indeed some devices, such as free weights, lack the ability to modify the work load of an exercise except in large increments (5 lbs, 10 lbs, etc). In addition, some equipment only allows the user to perform one repetitive exercise, which often leads to boredom and a lack of consistent use by the equipment's owners. There is therefore a need for a flexible, innovative and affordable device that can be used in a variety of exercises while allowing the user to adjust the workload of the device in small increments. The current invention is just such a device.

SUMMARY OF THE INVENTION

In the preferred embodiments, the exercise apparatus includes a pair of end cap assemblies, a plurality of disk assemblies and a plurality of weight assemblies. The plurality of disk assemblies and the plurality of weight assemblies are preferably secured between the end cap assemblies, in an alternating fashion. Each of the end cap assemblies also includes a handle that is preferably aligned in the same plane the handle of the other end cap assembly.

DETAILED DESCRIPTION OF THE PREFERRED EMBODIMENTS

Figure 1:
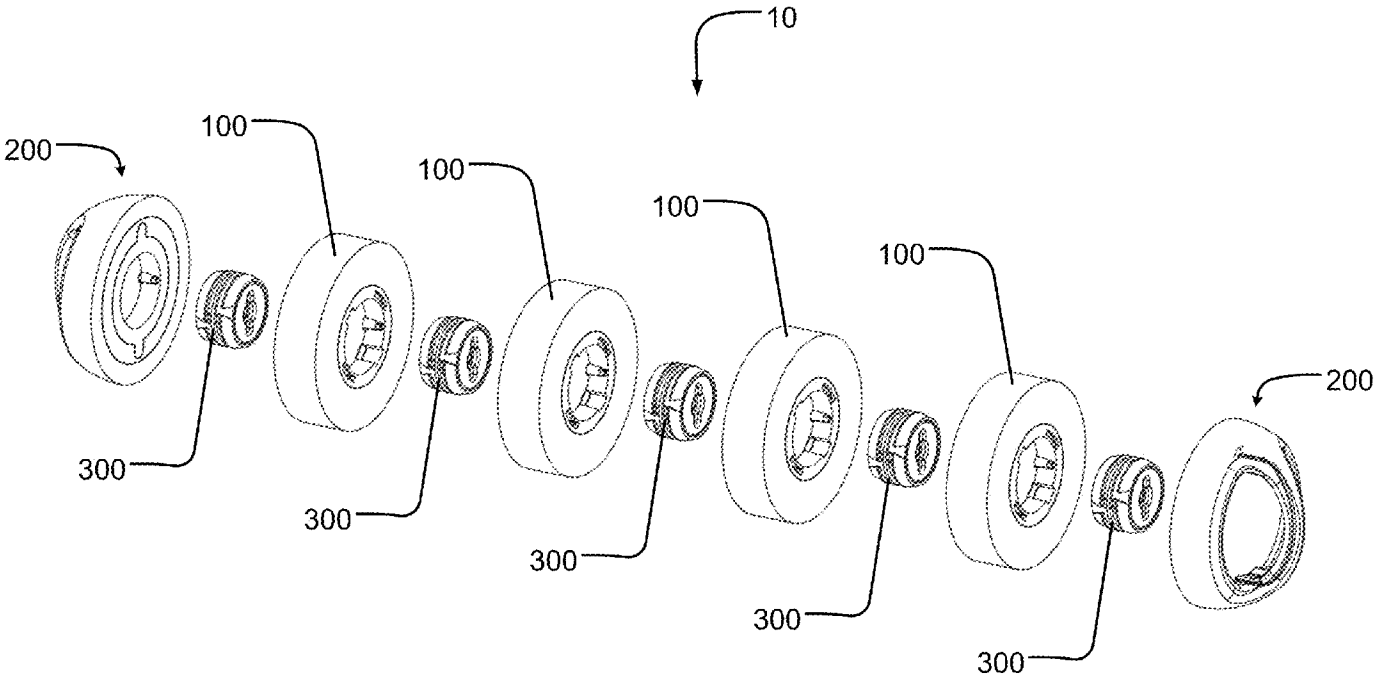
FIG. 1 is an exploded view of the exercise apparatus.
Figure 2:
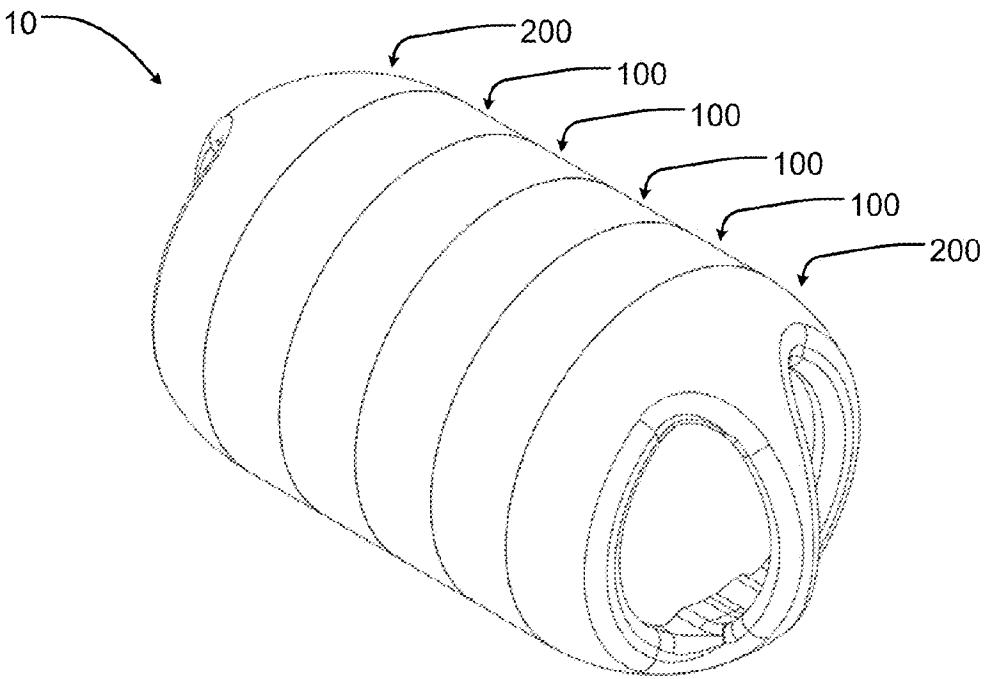
FIG. 2 is a perspective view of the exercise apparatus.

FIG. 1 depicts an exercise apparatus 10 constructed in accordance with the present invention. The exercise apparatus 10 includes two end cap assemblies 200, a plurality of disk assemblies 100 and a plurality of weight assemblies 300. Each of the disk assemblies 100, end cap assemblies 200, and weight assemblies 300 are each generally disk shaped. The end cap assemblies 200 are positioned on opposite ends of the exercise apparatus 10, with the disk assemblies 100 and weight assemblies 300 alternately positioned between the end cap assemblies 200. While FIG. 1 depicts the exercise apparatus 10 in a disassembled and exploded view, each of the assemblies 100, 200, 300 are configured to connect together to complete a single exercise apparatus (see FIGS. 2 and 6).

Figure 3:
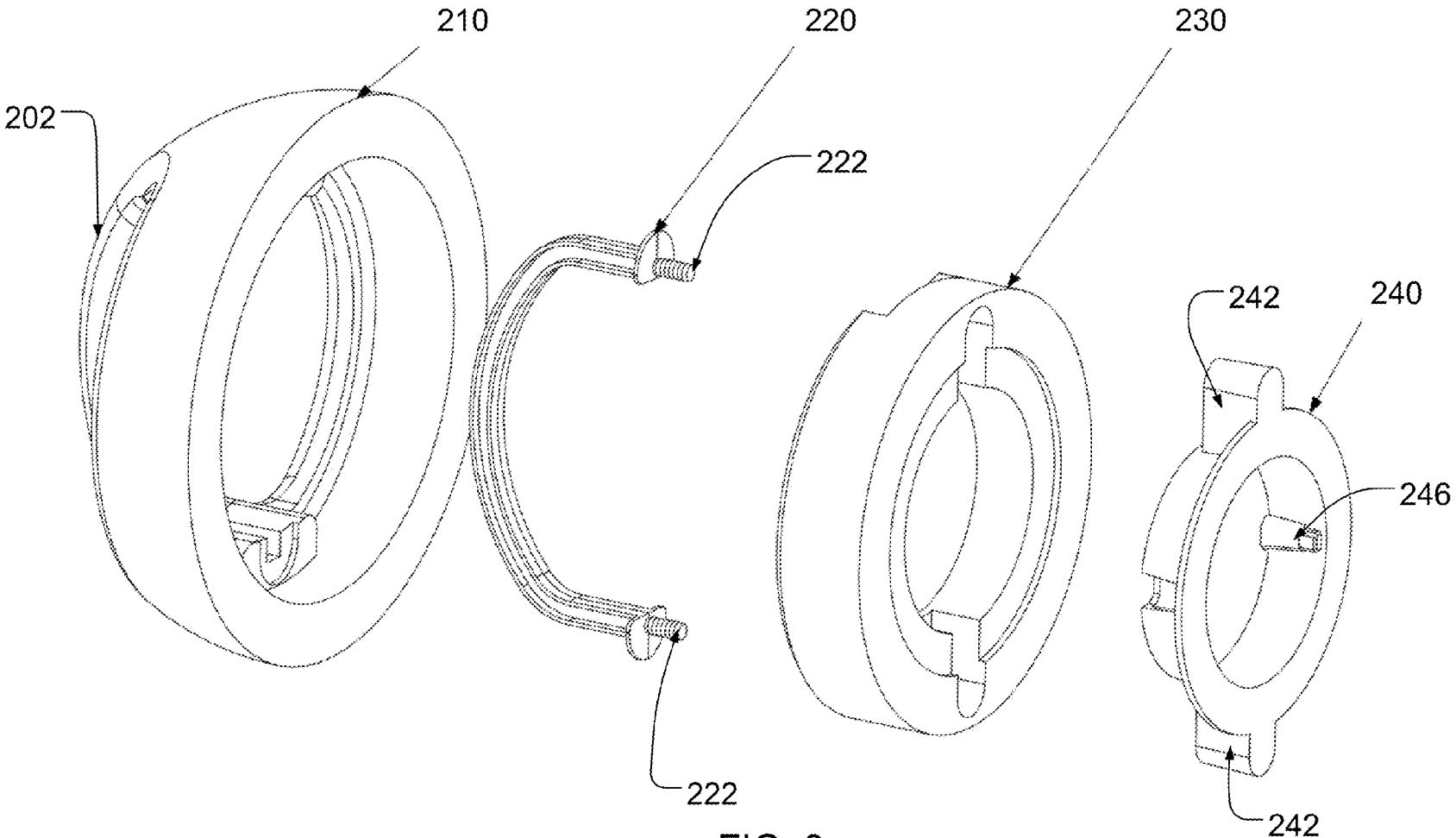
FIG. 3 is an exploded view of an end cap assembly of the exercise apparatus.

FIG. 3 shows an exploded view of one end cap assembly 200. As depicted, the end cap assembly 200 includes an end cap 210, a spine 220, an end cap insert 230 and an end cap female connector 240. Each end cap 210 includes a handle 202 that extends across the end cap assembly 200 and is configured to allow a user to grasp the end cap assembly (and thereby the exercise apparatus 10). In the preferred embodiment, each end cap 210 is constructed of a foam with good tensile strength, such as a high density EVA foam. The spine 220 is constructed of plastic and provides additional support and strength to the handle 202. The spine 220 includes a pair of end cap connector bolts 222. The end cap insert 230 fits within the end cap 210 and is also constructed of a firm plastic to provide additional support to the end cap assembly 200. The end cap female connector 240 includes a pair of bolt receivers 242 and is positioned within the end cap insert 230. The spine 220, end cap insert 230 and end cap female connector are secured together via the end cap connector bolts 222 of the spine 220. When assembled (see FIG. 6), the end cap connector bolts 222 pass through the end cap insert 230 and into the bolt receivers 242 on the end cap female connector 240. In the preferred embodiment, the end cap connector bolts 222 are pressure fitted within the bolt receivers 242, but it will be understood that other means can be used to attach the end cap connector bolts 222, such as by using an adhesive or anchor bolt.

Figure 4:
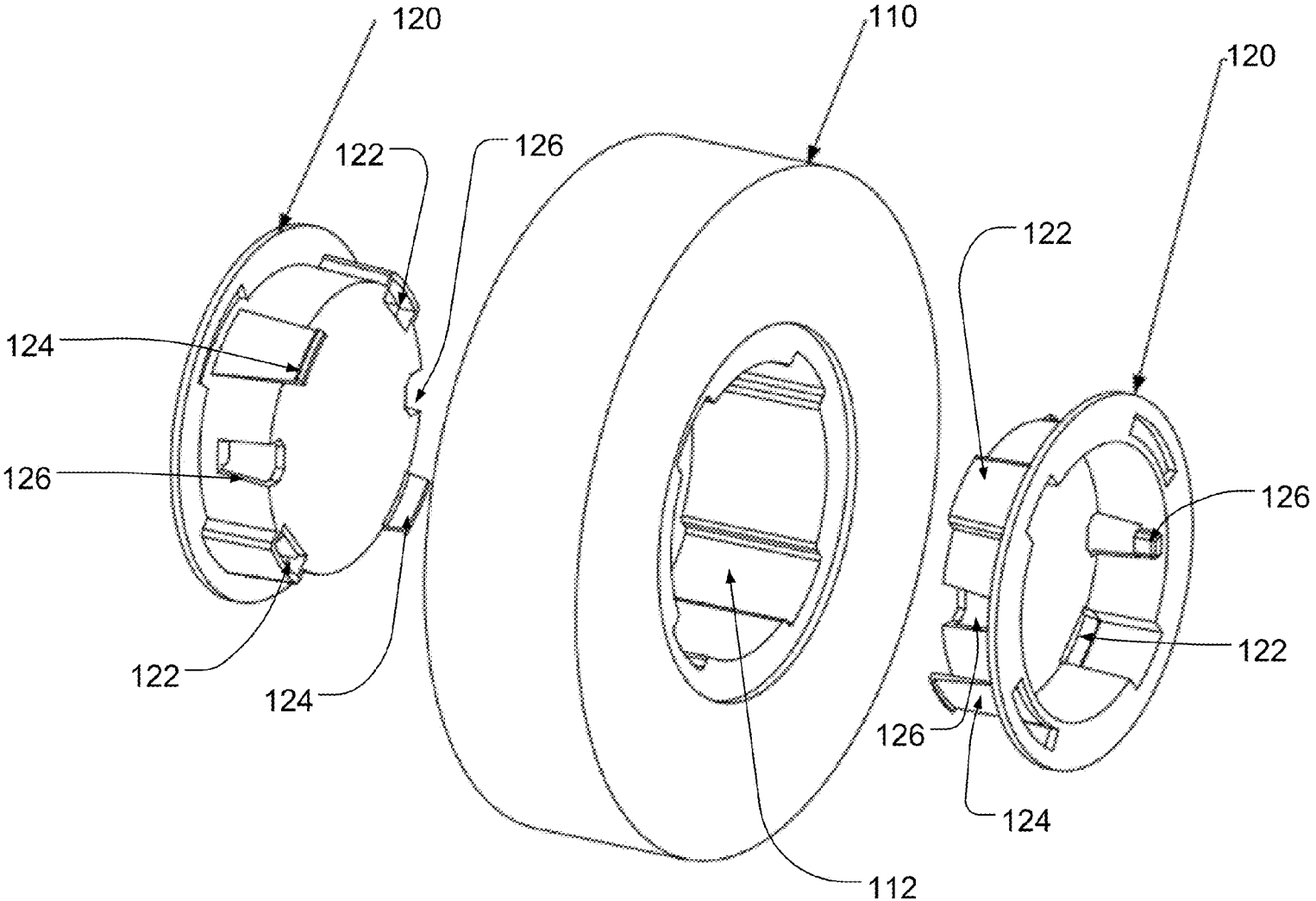
FIG. 4 is an exploded view of a weight assembly of the exercise apparatus.

FIG. 4 shows an exploded view of a disk assembly 100, which includes a foam disk 110 and a pair of female connectors 120. In the preferred embodiment, the foam disk 110 is constructed out of the same high density EVA foam from which the end cap 210 is constructed. A center hole 112 is cut into the foam disk 110 so that each of the female connectors 120 may be inserted into the foam disk 110. Each of the female connectors 120 include a plurality of slots 122, a plurality of tabs 124, and a plurality of locking flanges 126. Prior to inserting the female connectors 120 into the foam disk 110, the slots 122 and tabs 124 of one of the female connectors 120 in the disk assembly 100 are aligned with the respective tabs 124 and slots 122 of the other female connector 120, so that the tabs 124 of one female connector 120 can be inserted into the slots 122 of the other female connector 120 and vice versa.

Figure 5:
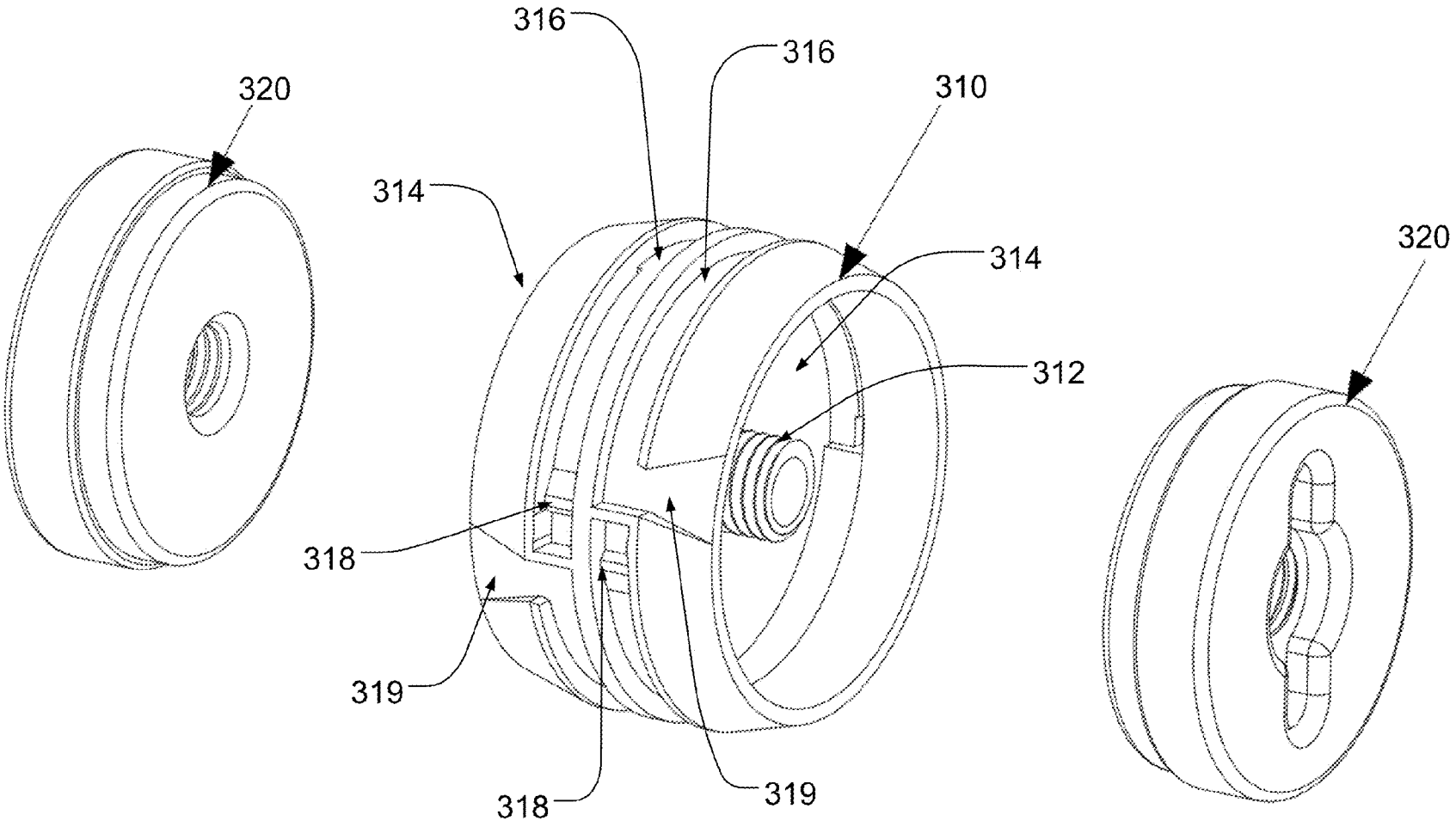
FIG. 5 is an exploded view of a disk assembly of the exercise apparatus.

FIG. 5 shows an exploded view of a weight assembly 300, which includes a pair of weights 320 and a male connector 310. The male connector 310 includes two sides 314. Each side 314 of the male connector includes a post 312 and a locking groove 316. Each locking groove 316 includes a plurality of locking ridges 318 and a plurality of groove entry points 319. Each of the weights 320 is secured within a separate side 314 of the male connector 310 by threadably engaging the weight 320 with the post 312, and continually rotating the weight 320 about the post 312 until it is fully secured within the side 314. Each weight 314 can be manufactured out of a variety of materials so that different weights 314 have different masses. In that way, a user can selectively choose to use weights 320 of a particular mass, and can thereby alter the total mass of weight assembly 300.

Figure 6:
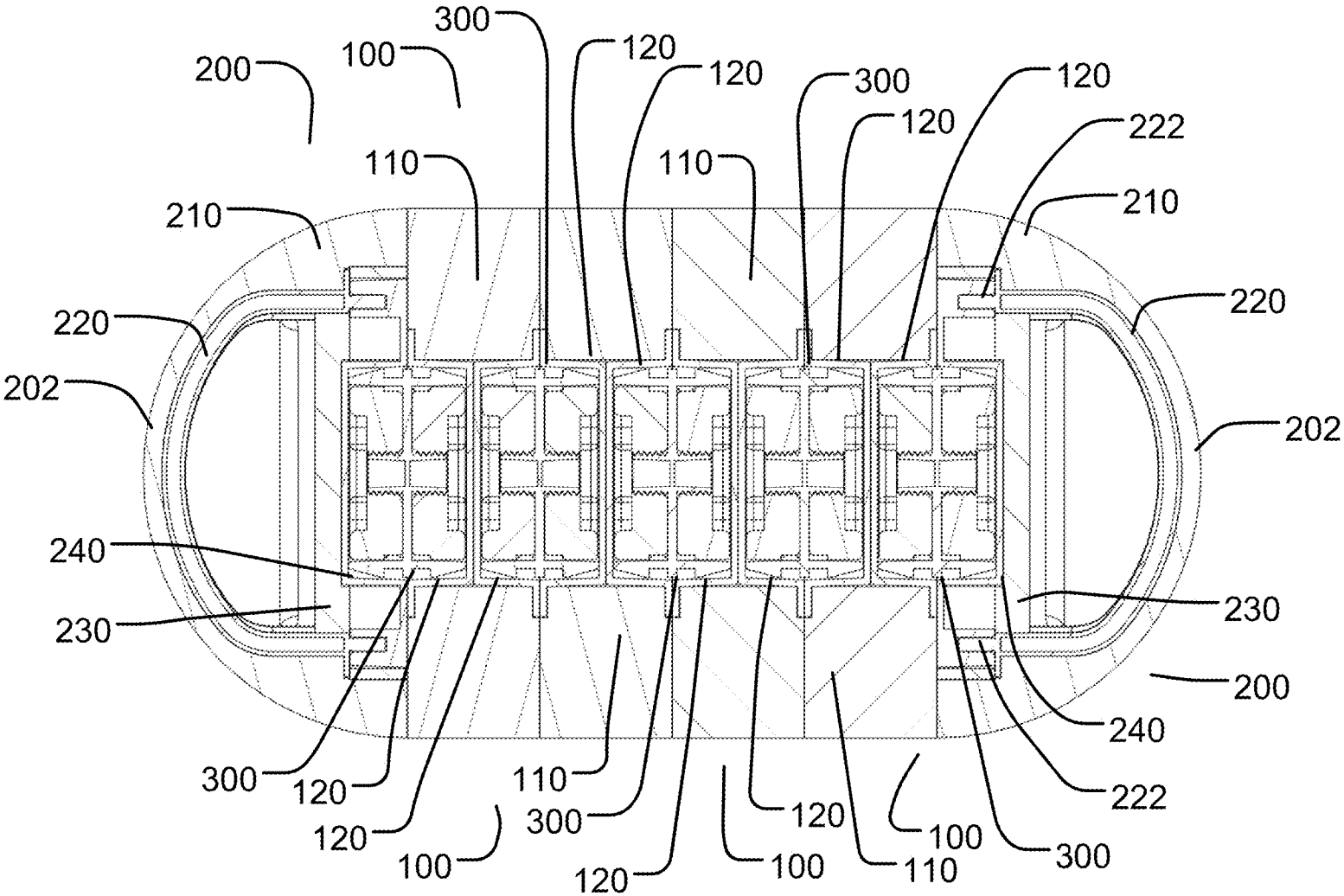
FIG. 6 is a cross section view of the exercise apparatus.

As depicted in FIGS. 1, 5 and 6, the exercise apparatus 10 is assembled by alternately connecting weight assemblies 300 and disk assemblies 100 between two end cap assemblies 200. This assembly begins by selecting the weight assemblies 300 and disk assemblies 100 to be used in the exercise apparatus 10. The overall length of the exercise apparatus 10 can be increased by adding disk assemblies 100 and weight assemblies 300, and can be decreased by removing disk assemblies 100 and weight assemblies 300. Likewise, the overall mass of the exercise apparatus 10 can also be modified by removing a selected number of weights 320 from the male connectors 310 or by replacing the weights 320 that are secured within the male connectors 310 with heavier weights 320 constructed of material with a higher density. Alternatively, the mass of the exercise apparatus 10 can be modified by using weights 320 with a higher or lower mass in the selected weight assemblies 300.

The selected assemblies are connected together by connecting the male connectors 314 of the selected weight assemblies 300 to the female connectors 120 of the disk assemblies 100. In the preferred embodiment, this connection is accomplished by pressing the plurality of locking flanges 126 of the female connector 120 into the groove entry points 319 of a selected side 314 of a selected male connector 310 and rotating that male connector 310 so that the locking flanges 126 travel along and within the locking groove 316 of that side 314 of that male connector 310 until the locking flanges 126 reaches the locking ridges 318 of the locking groove 316. Additional rotational force is used to move the locking flanges 126 past the locking ridges 318. Once past the locking ridges 318, the locking flanges 126 cannot move within the locking groove 316 without using a substantial amount of rotational force in a direction opposite to that used to originally move the locking flange 126 past the locking ridge 318. It is in this manner that the selected male connector 314 and selected female connector 120, as well as their respective weight assembly 300 and disk assembly 100, are then effectively connected to each other.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

The invention claimed is:

1. An exercise apparatus comprising:

a pair of end cap assemblies; a plurality of weight assemblies; a plurality of disk assemblies, wherein the plurality of the disk assemblies and the weight assemblies are alternately positioned between each of the end cap assemblies, the disk assemblies comprising:

a disk;

a hole positioned within the disk; and a pair of female connectors, the female connectors secured to each other and positioned within the hole.

2. The exercise apparatus of claim 1, wherein each of the end cap assemblies further comprises:

an end cap having a handle; an end cap insert positioned within the end cap; a spine positioned within the handle and extending through the end cap insert; and an end cap female connector positioned within the end cap insert and secured to the spine.

3. The exercise apparatus of claim 1, wherein each of the weight assemblies further comprises:

a male connector having a first side and a second side; and a pair of weights, wherein one of the weights is secured to the first side and the other weight is secured to the second side.

4. The exercise apparatus of claim 1 wherein each of the female connectors further comprises a locking flange.

5. The exercise apparatus of claim 4 wherein each of the weight assemblies further comprises:

a male connector having a first side and a second side; and a pair of weights, wherein one of the weights is secured to the first side and the other weight is secured to the second side.

6. The exercise apparatus of claim 5 wherein each of the male connectors further comprises:

a locking groove, having a groove entry point and a locking ridge.

7. The exercise apparatus of claim 6 wherein each male connector can be selectively secured to a female connector by pressing the locking flange of the female connector into the locking groove and rotating the male connector until the locking flange is moved across the locking ridge.

8. An exercise apparatus comprising:

two end cap assemblies, each having a handle;

a plurality of disk assemblies positioned adjacent one another between the handles;

a weight assembly positioned between each end cap assembly and the adjacent disk assembly to connect the end cap assembly to the disk assembly;

at least one weight assembly positioned between adjacent disk assemblies to connect adjacent disk assemblies.

9. The exercise apparatus of claim 8 wherein the handles are positioned in the same plane.

10. The exercise apparatus of claim 8 wherein the plurality of disk assemblies form a cylindrical shape.

11. The exercise apparatus of claim 8 wherein each disk assembly has a foam exterior surface.

12. The exercise apparatus of claim 8 wherein the end cap assemblies, disk assemblies and weight assemblies lockingly engage allowing a user to vary the length of the exercise apparatus.

13. The exercise apparatus of claim 12 wherein the handles are positioned in the same plane.

14. The exercise apparatus of claim 13 wherein the plurality of disk assemblies form a cylindrical shape.

15. The exercise apparatus of claim 14 wherein each disk assembly has a foam exterior surface.

16. An exercise apparatus comprising:

two end cap assemblies, wherein each of the end cap assemblies further comprises:

an end cap having a handle; an end cap insert positioned within the end cap; a spine positioned within the handle and extending through the end cap insert; an end cap female connector positioned within the end cap insert and secured to the spine; and the handles of each end cap assembly positioned in the same plane; and a plurality of disk assemblies having a foam exterior surface, the plurality of disk assemblies positioned adjacent one another between the handles to form a cylindrical shape, wherein each of the disk assemblies further comprises:

a disk;

a hole positioned within the disk;

a pair of female connectors, wherein each female connector having a locking flange; and the female connectors secured to each other and positioned within the hole;

a weight assembly positioned between each end cap assembly and the adjacent disk assembly to connect the end cap assembly to the disk assembly, wherein each of the weight assemblies further comprises:

a male connector having a first side and a second side, a locking groove, a groove entry point and a locking ridge;

a pair of weights, wherein one of the weights is secured to the first side and the other weight is secured to the second side;

each male connector capable of being secured to a female connector by pressing the locking flange of the female connector into the locking groove and rotating the male connector until the locking flange is moved across the locking ridge; and at least one weight assembly positioned between adjacent disk assemblies to connect adjacent disk assemblies.

17. An exercise apparatus comprising:

a pair of end cap assemblies, each of the end cap assemblies further comprises:

an end cap having a handle;

an end cap insert positioned within the end cap;

a spine positioned within the handle and extending through the end cap insert; and an end cap female connector positioned within the end cap insert and secured to the spine;

a plurality of weight assemblies; and a plurality of disk assemblies, wherein the plurality of the disk assemblies and the weight assemblies are alternately positioned between each of the end cap assemblies.

18. An exercise apparatus comprising:

a pair of end cap assemblies;

a plurality of weight assemblies, each of the weight assemblies further comprises:

a male connector having a first side and a second side; and a pair of weights, wherein one of the weights is secured to the first side and the other weight is secured to the second side;

a plurality of disk assemblies, wherein the plurality of the disk assemblies and the weight assemblies are alternately positioned between each of the end cap assemblies.

* * * * *